343-700 MS AU 251 EX
3/20/85 OR 4,507,664

United States Patent [19]
James et al.

[11] Patent Number: 4,507,664
[45] Date of Patent: Mar. 26, 1985

[54] DIELECTRIC IMAGE WAVEGUIDE ANTENNA ARRAY

[75] Inventors: James R. James; Ann Henderson, both of Swindon, England

[73] Assignee: The Secretary of State for Defence in Her Britannic Majesty's Government of the United Kingdom of Great Britain and Northern Ireland, London, England

[21] Appl. No.: 389,069

[22] Filed: Jun. 16, 1982

[30] Foreign Application Priority Data

Jun. 16, 1981 [GB] United Kingdom ..... 8118509
Jul. 10, 1981 [GB] United Kingdom ..... 8121408

[51] Int. Cl.[3] ..... H01Q 1/38
[52] U.S. Cl. ..... 343/700 MS; 343/785; 333/246
[58] Field of Search ..... 343/700 MS, 785

[56] References Cited

U.S. PATENT DOCUMENTS

| | | | |
|---|---|---|---|
| 2,761,137 | 8/1956 | Van Atta et al. . | |
| 2,929,065 | 3/1960 | Kreinheder | 343/785 |
| 2,993,205 | 7/1961 | Cooper | 343/785 |
| 3,155,975 | 11/1964 | Chatelain | 343/700 MS |
| 3,225,351 | 12/1965 | Chatelain et al. | 343/700 MS |
| 3,283,330 | 11/1966 | Chatelain | 343/700 MS |
| 3,568,208 | 3/1971 | Hatcher et al. | 343/785 |
| 3,771,077 | 11/1973 | Tischer | 343/785 |
| 4,028,643 | 6/1977 | Itoh . | |
| 4,054,874 | 10/1977 | Oltman, Jr. | 343/700 MS |
| 4,063,245 | 12/1977 | James et al. | 343/700 MS |
| 4,091,343 | 5/1978 | Knox . | |
| 4,203,116 | 5/1980 | Lewin | 343/700 MS |
| 4,378,558 | 3/1983 | Lunden | 343/785 |

FOREIGN PATENT DOCUMENTS

| | | | |
|---|---|---|---|
| 2824053 | 5/1978 | Fed. Rep. of Germany | 343/700 MS |
| 55-97703 | 7/1980 | Japan | 343/700 MS |
| 2064877 | 6/1981 | United Kingdom | 343/700 MS |
| 2097196 | 10/1982 | United Kingdom | 343/700 MS |

OTHER PUBLICATIONS

T. Itoh, "Leaky-Wave Antenna and Band-Reject Filter for Millimeter-Wave Integrated Circuits", 1977 IEEE MIT-S International Microwave Symposium Digest, Jun. 21-23, 1977, pp. 538-541.

K. Solbach, "Millimeterwellen-Schaltungen in der Technik der dielektrischen Bildleitungen", Nachrichten Elektronik, vol. 33, No. 10, Oct. 1979, pp. 333-337.

J. R. James, "Some Recent Developments in Microstrip Antenna Design", IEEE Transactions on Antennas & Propagation, vol. AP-29, No. 1, Jan. 1981, pp. 124-128, New York, (U.S.A.).

"New Wideband Microstrip Antenna Using Log-Periodic Technique", Electronics Letters, Feb. 14, 1980, vol. 16, No. 4, pp. 127-128.

"A Printed Millimetre Wave Array Using a Low Loss Dielectric Waveguide Feeder", M. T. Birand, N. Williams, M. Inggs, Second International Conf. on Antennas & Kopagation, York, Eng., Apr. 13-16, 1981.

"Experimental 30 GHz Printed Array with Low Loss Insular Guide Feeder", Electronics Letters, Feb. 5, 1981, vol. 17, No. 3, pp. 146-147.

R. H. DuHamel et al., "Launching Efficiency of Wires and Slots for a Dielectric Rod Waveguide", IRE Transactions on MTT, Jul. 1958, pp. 277-284, New York, (U.S.A.).

A. Henderson et al., "New Low-Loss Millimetre-Wave Hybrid Microstrip Antenna Array", Conference Proceedings 11th European Microwave Conference, Sep. 7-11, 1981, pp. 825-830, Sevenoaks, (GB).

M. T. Birand et al., "Experimental Dielectric Radiators Fed by Means of Dielectric Waveguide", Electronics Letters, vol. 17, No. 18, Sep. 1981, pp. 633-635, London, (GB).

*Primary Examiner*—Eli Lieberman
*Assistant Examiner*—K. Ohralik
*Attorney, Agent, or Firm*—Stevens, Davis, Miller & Mosher

[57] ABSTRACT

An antenna array comprises a dielectric image waveguide (3) acting as a feeder, which may be of the insular or inverted-strip type, in contact with a dielectric sheet (1). On the sheet (1) is located a plurality of strips (4) of metallizing extending outwards from the feeder-guide (3). The inner ends of the strips are located to couple with the feeder-guide and their outer ends act to radiate or receive most of the power. Preferably the mode propagated in the feeder-guide is an $E_{mn}^{y}$ mode higher than the fundamental, suitably the $E_{21}^{y}$ mode.

11 Claims, 10 Drawing Figures

DIELECTRIC IMAGE WAVEGUIDE ANTENNA ARRAY

This invention relates to antenna arrays.

Microstrip arrays are known, eg as described in British Patent Specification No. 1,529,361, which comprise a plurality of strips of metallising formed on the surface of an insulating substrate backed by a metallic ground-plane, the strips extending at regular intervals from a feeder strip of similar metallising. Although such arrays are suitable at microwave frequencies, eg in the range 3–30 GHz (free-space wavelength 1–10 cm), at millimeter (free-space) wavelengths such microstrip feeders become very lossy.

It is known that dielectric image waveguides are less lossy than microstrip lines at millimeter wavelengths. The present invention takes advantage of this fact to provide antenna arrays which are less lossy at such wavelengths than the above-described type, while retaining the cheapness and ease of manufacture of microstrip antennas. Additionally, the present antennas give better control of the radiation pattern than do millimeter antennas which use dielectric image waveguides provided with notches to act as radiating elements.

According to the present invention an antenna array comprises:

a dielectric image waveguide system comprising a conducting ground-plane, a planar dielectric sheet, and a longitudinally extending dielectric feeder-guide of greater thickness than the sheet and in surface-to-surface contact with the sheet;

and a plurality of conducting-sheet strips on a surface of said dielectric sheet spaced along and extending outwards from said feeder-guide, the inner ends of the strips being located relative to the feeder-guide so as to effect electromagnetic coupling therewith, and their outer ends serving, in use, to radiate or receive most of the power.

The image waveguide system may be of the insular type, ie in which the ground-plane is on one surface of the dielectric sheet and the feeder-guide lies on the other surface of the dielectric sheet, the relative permittivity of the guide being greater than that of the sheet. In this case the strips are on the same surface of the sheet as is the guide. The inner ends of the strips may be slightly spaced from the side of the guide, or alternatively may contact or underlie it to increase the coupling.

The image waveguide system may alternatively be of the inverted strip type, ie in which the dielectric feeder-guide is sandwiched between the ground-plane and the dielectric sheet, the relative permittivity of the feeder being less than that of the sheet. In this case the strips may be on either surface of the dielectric sheet. As with the insular guide system, the inner ends of the strips may be spaced from the side of the guide, or likewise be colinear therewith or extend inwards thereof to increase the coupling.

The strips may be spaced along either or both sides of the feeder-guide and, for broadside radiation, are suitably located at wavelength intervals (ie the wavelength in the guide) therealong at one or each side. Suitably the strips are approximately a half-wavelength long (ie a half-wavelength in the strip) for matching purposes. The strips may extend at right angles to the feeder-guide or may be inclined at an angle thereto, eg strips angled at 45° with those on one side spaced a quarter-wavelength from those on the other will give circular polarisation.

The feeder-guide and wave-launcher thereinto may be adapted to propagate in the guide a mode which is higher than the fundamental mode, suitably the $E_{21}^{y}$ mode rather than the $E_{11}^{y}$ mode, in order to promote good coupling between the guide and the strips and thereby improve the efficiency and resulting radiation pattern of the array (the overall pattern being affected not only by radiation from the strips themselves, by by any unwanted radiation from the launcher and termination).

To enable the nature of the present invention to be more readily understood, attention is directed, by way of example, to the accompanying drawings wherein.

Figure 1:
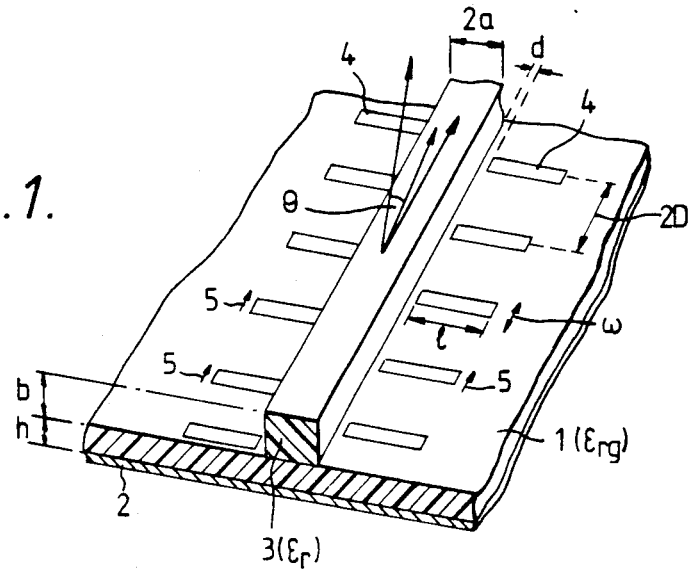
FIG. 1 is a perspective cross-sectional view of one array embodying the invention.

In FIG. 1 is shown an insular image waveguide system comprising the conventional features of a dielectric sheet 1 having a conducting ground-plane 2 on its under surface and a rectangular cross-section dielectric waveguide 3 on its upper surface. The relative permittivity of guide 3, $\epsilon_r$, is greater than that of sheet 1, $\epsilon_{rg}$, in a known manner. To form an array in accordance with the present invention, there is spaced along each side of guide 3 is a plurality of strips 4 of metallising applied, eg by conventional printing, to the upper surface of sheet 1. The strips on one side are spaced halfway between those on the other side, and the distance between adjacent strips on each side is 2D. In this embodiment, intended to produce broadside radiation, ie with the main beam normal to the plane of sheet 1, $2D=\lambda_I$, where $\lambda_I$ is the wavelength in guide 3 at the intended operating frequency. For other beam directions, other values of 2D may be used, in a manner familiar to those skilled in antenna design. The strips 4 are of length l, and suitably $l=\lambda_m/2$ where $\lambda_m$ is the wavelength in the strips 4 at the intended operating frequency, this length being used to promote good matching. The inner end of each strip is spaced from the guide 3 by a distance d and the strip width is w. The guide width and height are respectively $2a$ and $b$, and the thickness of sheet 1 is h.

The input or output connection to one end of guide 3 is made in a conventional manner. The other end may be terminated with the characteristic impedance of the guide for operation in a travelling-wave mode, or left open-circuit for operation in a resonant mode. It is found that despite both ends of each strip having a free edge, unlike the corresponding strips in the aforementioned British Patent, the radiation is likewise, as therein, primarily from the outer ends of the strips 4 which can be regarded as acting as oscillating magnetic dipoles, as indicated by the arrows 5. With the described spacing, all the dipoles oscillate in phase so that the main beam is normal to the plane of the array, but the spacing can be altered to vary its direction in a known manner.

The present combination of microstrip radiators 4 with a dielectric image waveguide feeder allows the values of h and $\epsilon_{rg}$ to be chosen so as to achieve efficient radiation from the strips 4, while avoiding the losses at millimeter wavelengths which use of a microstrip feeder, as in the aforementioned British Patent, would involve.

The mechanism of the coupling between the inner ends of the strips 4 and the guide 3 is not fully understood, but an estimate has been made based on the Lorentz reciprocity theorem (see eg Barlow, H M and Brown, J, "Radio surface waves". Section 9.3, pp 82–85, 1962 (OUP)), and, without wishing to be bound thereby, the result appears to agree reasonably well with experimental results. Using this theorem, the percentage of the power flowing in the guide 3, $P_I$, which is coupled into each strip 4 is estimated as $$100\,\frac{hw}{P_I}\sqrt{\frac{\epsilon_{rg}\epsilon_o}{\mu_o}}\;e^{-\alpha d}\cdot\frac{\left|\int_A E_I\cdot E_M\,dA\right|^2}{\left|\int_A E_M\cdot E_M\,dA\right|^2}\;\%$$

where $P_I$ is determined from modal considerations and $E_I$ and $E_M$ are the electric fields in the guide 3 and the strip 3 respectively (see McLevige et al, IEEE Trans Microwave Theory Tech., vol MTT-23, pp 788–794 (October 1975); $\alpha$ is the decay factor given by $\sqrt{\beta^2-k^2}$ (where $\beta$ is the mode propagation constant $=2\pi/\lambda_I$ and $k=2\pi/\lambda_o$, $\lambda_o$ being the free-space wavelength) and A is the coupling aperture, taken as approximately the area hw under the strip 3. $\mu_o$ is the free-space magnetic permeability, and $\epsilon_o$ the free-space permittivity.

Figure 2:
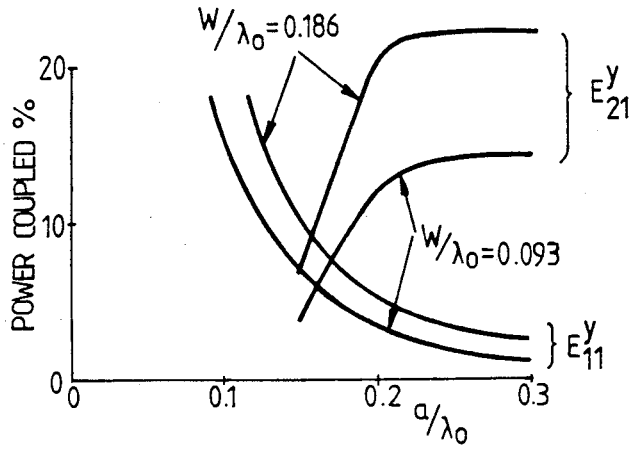
FIG. 2 shows graphical plots of the coupling between the dielectric guide and strips of metallising in the array of FIG. 1.

FIG. 2 shows computations of percentage power coupled for two different propagation modes in the guide 3, viz the $E_{11}{}^y$ (ie fundamental) and $E_{21}{}^y$ modes, and for two different values of $w/\lambda_o$, viz 0.186 and 0.093; $b/\lambda_o=0.15$, $h/\lambda_o=0.03$, d=0, and $\epsilon_{rg}=2.32$, $\epsilon_r=10.5$, for all four curves. The percentage is plotted against $a/\lambda_o$.

The $E_{mn}{}^y$ mode type designates a hybride mode with both L and E and H fields along the propagation direction but with a predominantly vertical (y) E field. Suffixes m and n indicate the number of modes in the transverse x and y directions. It can be seen that the degree of coupling is considerably higher for the $E_{21}{}^y$ mode than for the fundamental mode $E_{11}{}^y$ and for this reason the embodiments to be described were designed on the basis of the higher order mode. The accuracy of these estimations is limited by the approximations taken; the effective dielectricconstant method described by McLevige et al (see above reference) is used, approximating both $\beta_I$ and the field forms within the guide 3. Tighter coupling may be obtained by causing the strips 4 to extend inwards under the guide 3, ie making d negative, in which case some adjustment of the strip length may be necessary.

Embodiments of the array of FIG. 1 have been constructed for use at 14 and 70 GHz, the latter being scaled-down versions of the former, for operation in both the resonant and travelling-wave modes. In each case 32 strips 4 were used (16 on each side of the guide 3), with d=0, $D=\lambda_I/2$, $1=\lambda_m/2$, other parameters as for FIG. 2. At both frequencies the guide 3 was operated in the $E_{21}{}^y$ mode.

Figure 3:
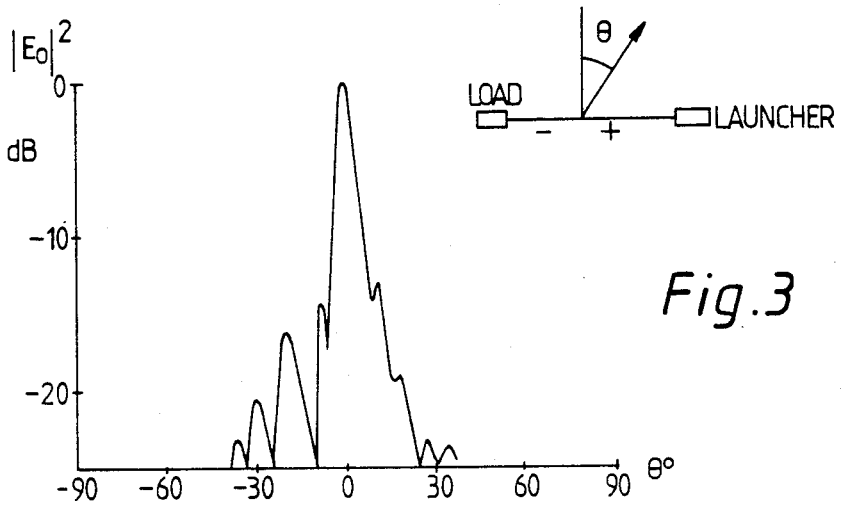
FIGS. 3–6 show radiation patterns obtained with the array of FIG. 1.

FIG. 3 shows the measured radiation pattern of a 14 GHz ($\lambda_o=21.5$ mm) travelling-wave embodiment fed by a conventional probe/coaxial launcher. The angle $\theta$ is the angle made with the normal to the plane of the array in the plane of the array axis (see FIG. 1), and $E_o$ is the electric field strength in the direction $\theta$. The launcher comprised a 1 mm wide metal strip extending between the guide 3 and the sheet 1, which was tuned to a length of 15 mm for optimum VSWR at the coaxial feed; the guide 3 was tapered in height over the metal-strip probe in a known manner. The residual unradiated power at the termination of guide 3 was absorbed into a lossy painted load. Calculations based on FIG. 2 indicate that substantially less power has to be absorbed in the load for the higher-order mode $E_{21}{}^y$ than for the $E_{11}{}^y$ mode. Measurements on a 14 GHz antenna in which the guide 3 was dimensioned to propagate the fundamental $E_{11}{}^y$ mode but not the $E_{21}{}^y$ mode confirm the lower efficiency and resulting poorer radiation pattern predicted by the calculations.

Figure 4:
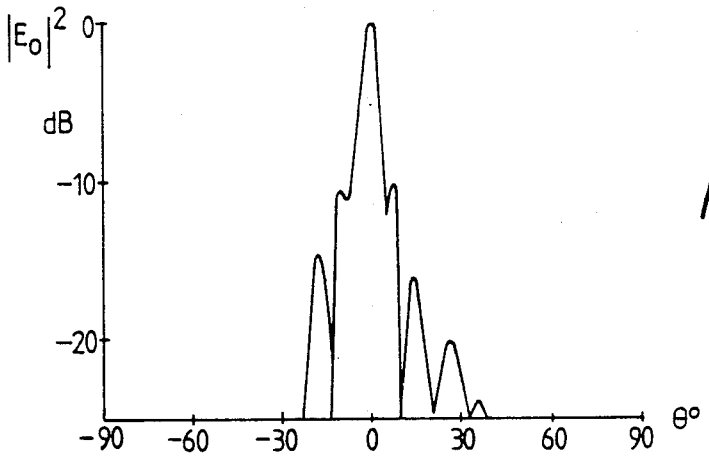

FIG. 4 shows the radiation pattern of the 14 GHz array in the resonant mode, using the same probe/coaxial launcher as for FIG. 3. In both FIG. 3 and FIG. 4, the launcher radiation was screened by lossy material, and cross-polarisation was further reduced to less than −15 dB by screening the terminations. Improvements in the side-lobe levels may be obtainable by tapering the widths of the strips 4 along the lengths of the arrays.

Figure 5:
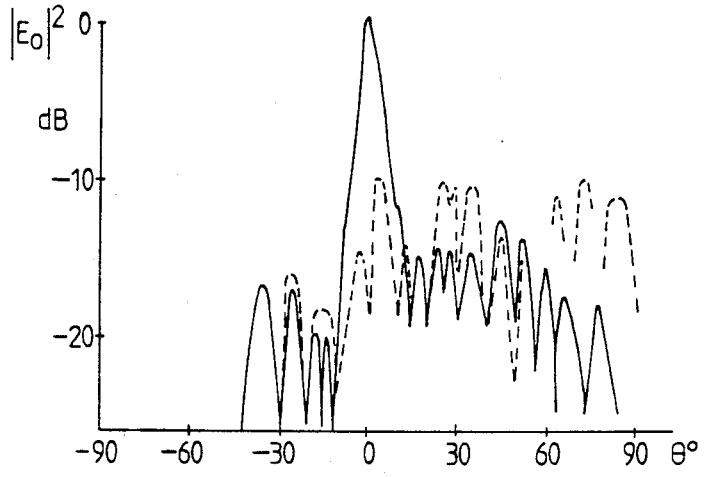
Figure 6:
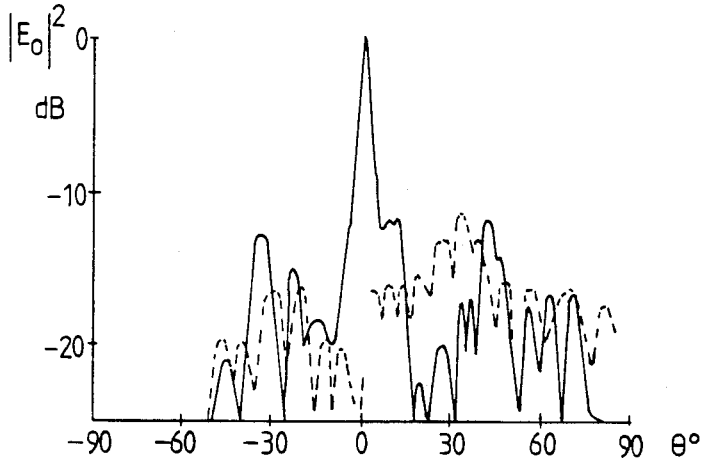
Figure 9:
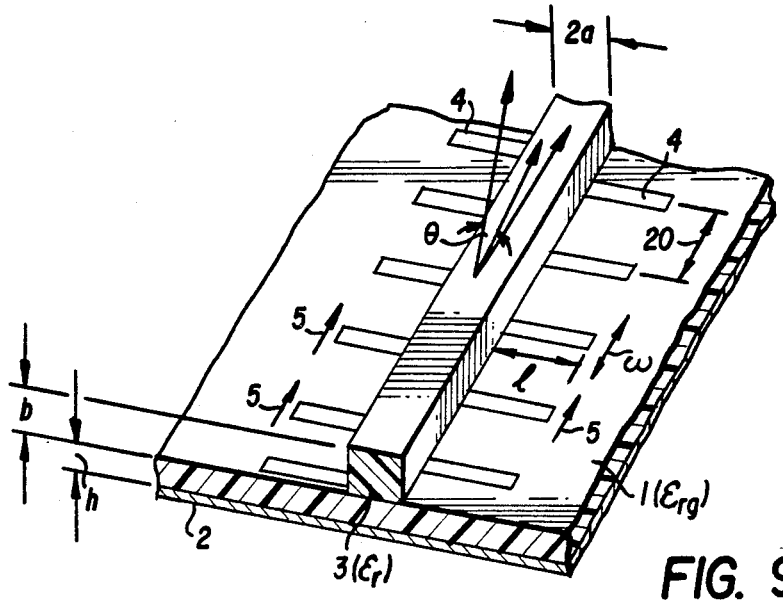
FIG. 9 is a perspective cross-sectional view illustrating inner ends of the strips contacting the side of the guide.
Figure 10:
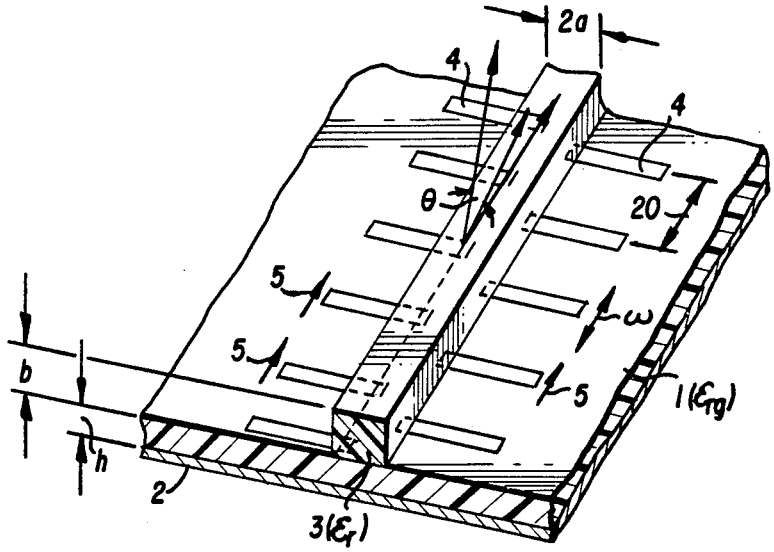
FIG. 10 is a perspective cross-sectional view illustrating inner ends of the strips underlying the side of the guide.

FIGS. 5 and 6 show the corresponding patterns for the 70 GHz ($\lambda_o=4.3$ mm) travelling-wave and resonant arrays respectively. Both arrays were fed by unscreened rectangular hollow waveguides into which projected the ends of the guides 3; this accounts for the much-increased cross-polarisation indicated by the interrupted lines. In a further 70 GHz travelling-wave array, the strips 4 extended under the guide 4 so that d=−0.6 mm (the total length of each strip remaining unchanged), and it was found that up to 90% of the input power could be coupled into strips, thus increasing the efficiency of the array.

Figure 7:
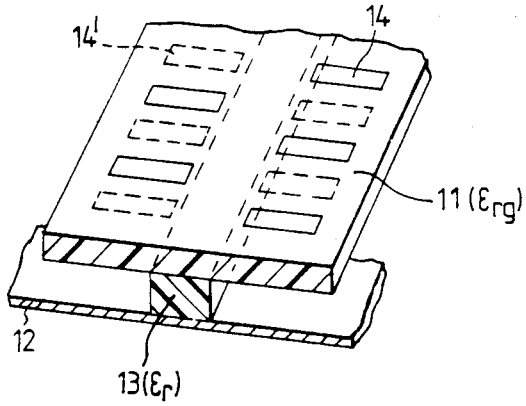
FIG. 7 is a perspective cross-sectional view illustrating a further embodiment of the invention.

FIG. 7 shows a further embodiment in which the image waveguide is of the inverted strip type, with the dielectric feeder-guide 13 sandwiched between the ground-plane 12 and the dielectric sheet 11. In this case $\epsilon_{rg}$ is greater than $\epsilon_r$. The strips of metallising may be either on the upper surface of sheet 11, as shown at 14, or on its lower surface, as shown at 14'. The electrical behaviour is similar to that of FIG. 1, and the location of the inner ends of the strips relative to the side of the guide may be varied correspondingly to vary the coupling.

Figure 8:
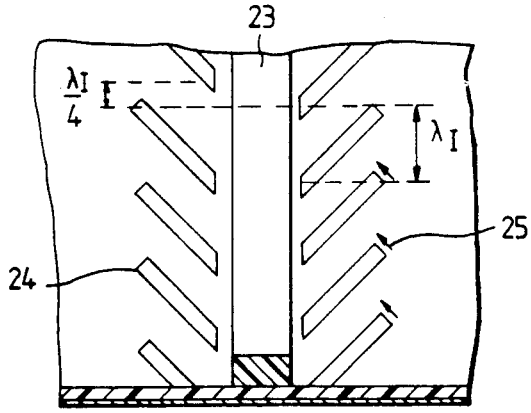
FIG. 8 is a plan view, showing also a cross-section in perspective, of a modification of the embodiment of FIG. 1.

FIG. 8 shows a further embodiment, reverting to the image waveguide system of FIG. 1, but with the strips 24 angled at 45° to the axis of the guide 23 so that the notional dipoles 25 at their outer ends are similarly angled. Also, the strips on one side, instead of being midway, ie $\lambda_I/2$, between those on the other side, are located at a spacing $\lambda_I/4$ relative thereto, as shown. In consequence, a circularly polarised radiation pattern is obtained. A similar effect can be obtained using the arrangement of FIG. 7 by angling and locating the strips 14 or 14' appropriately. Other relevant variations in strip width and spacing can be adopted in a manner similar to that described in the aforesaid British Patent, in order to obtain corresponding results.

The described embodiments use an image guide feeder of rectangular cross-section, but this is not essential.

The described embodiments have been described in terms of transmitting arrays but are, of course, equally suitable for receiving.

We claim:

1. An antenna array comprising:

a dielectric image waveguide system comprising a conducting ground-plane, a planar dielectric sheet backed by said ground-plane, and a longitudinally extending dielectric feeder-guide of greater thickness than the sheet, said feeder-guide having a substantially different relative permittivity from that of the sheet and being in surface-to-surface contact with the sheet; and a plurality of conducting-sheet strips on a same surface of said dielectric sheet as said feeder-guide and spaced along and extending outwards from said feeder-guide, said strips being electrically insulated from said ground plane, the inner ends of the strips being located relative to the feeder-guide so as to effect electromagnetic coupling therewith, and their outer ends serving, in use, to radiate or receive most of the power.

2. An array as claimed in claim 1 wherein the image waveguide system is of the insular type and the inner ends of the strips are spaced outward from the side of the guide.

3. An array as claimed in claim 1 wherein the inner ends of the strips contact the side of the guide.

4. An array as claimed in claim 1 wherein the inner ends of the strips underlie the side of the guide.

5. An array as claimed in claim 1 wherein the strips are approximately a half wavelength long.

6. An array as claimed in claim 1 wherein the strips extend at right angles to the feeder guide.

7. An array as claimed in claim 1 wherein the strips extend from both sides of the guide, those extending from one side being spaced halfway between those extending from the other side.

8. An array as claimed in claim 1 wherein said guide comprises means for receiving at one end and for propagating in the guide, an $E_{mn}^{y}$ mode higher than the fundamental mode.

9. An array as claimed in claim 8 wherein the mode is the $E_{21}^{y}$ mode.

10. An antenna array comprising:

a dielectric image waveguide of the insular type, comprising a dielectric sheet backed by a conducting ground-plane and a longitudinally extending dielectric feeder guide having a greater thickness than the dielectric sheet and in surface contact therewith, the relative permittivity of the guide material being greater than that of the sheet material; and a plurality of conducting-sheet radiators on a same surface of said dielectric sheet as said feeder-guide, said radiators being electrically insulated from said ground-plane and spaced along said feeder guide with their inner edges located relative to the feeder guide so as to effect electromagnetic coupling therewith, said radiators being dimensioned to be resonant at the operating frequency of the array.

11. An array as claimed in claim 10 wherein said inner edges of the radiators are spaced outward from the side of the guide.

* * * * *